US009489000B2

(12) United States Patent
Caffee et al.

(10) Patent No.: US 9,489,000 B2
(45) Date of Patent: Nov. 8, 2016

(54) USE OF A THERMISTOR WITHIN A REFERENCE SIGNAL GENERATOR

(71) Applicant: Silicon Laboratories Inc., Austin, TX (US)

(72) Inventors: Aaron J. Caffee, Scappoose, OR (US); Brian G. Drost, Corvallis, OR (US)

(73) Assignee: Silicon Laboratories Inc., Austin, TX (US)

( * ) Notice: Subject to any disclaimer, the term of this patent is extended or adjusted under 35 U.S.C. 154(b) by 310 days.

(21) Appl. No.: 14/040,839

(22) Filed: Sep. 30, 2013

(65) Prior Publication Data

US 2015/0091537 A1 Apr. 2, 2015

(51) Int. Cl.
*G05F 3/16* (2006.01)
*G05F 1/575* (2006.01)

(52) U.S. Cl.
CPC ..... *G05F 1/575* (2013.01)

(58) Field of Classification Search
CPC ..... G05F 3/30; G05F 3/247
USPC ..... 323/313, 314, 366, 369
See application file for complete search history.

(56) References Cited

U.S. PATENT DOCUMENTS 6,954,020 B2 10/2005 Ma et al.
7,224,210 B2 5/2007 Garlapati et al.
7,253,677 B1 * 8/2007 Kuramochi ..... G05F 3/205 327/535
7,321,225 B2 1/2008 Garlapati et al.
7,724,068 B1 * 5/2010 Smith ..... G01K 3/005 327/513
7,852,144 B1 * 12/2010 Zonte ..... G05F 3/30 327/513
7,854,174 B2 12/2010 Aebersold et al.
7,982,550 B1 7/2011 Quevy et al.
2007/0247245 A1 10/2007 Hagelin
2007/0273407 A1 * 11/2007 Ueda ..... H03K 19/00384 326/83
2007/0290763 A1 12/2007 Partridge et al.
2008/0007362 A1 1/2008 Partridge et al.
2009/0051342 A1 * 2/2009 Peng ..... G05F 3/30 323/313
2009/0121808 A1 5/2009 Van Beek et al.
2010/0225483 A1 9/2010 Scheucher et al.
2011/0057709 A1 3/2011 Laraia et al.

(Continued)

OTHER PUBLICATIONS

Perrott, Michael H., "A Temperature-to-Digital Converter for a MEMS-Based Programmable Oscillator With <±0.5-ppm Frequency Stability and <1-ps. Integrated Jitter," IEEE Journal of Solid-State Circuits, vol. 48, No. 1, Jan. 2013, pp. 276-291.

(Continued)

*Primary Examiner* — Adolf Berhane
*Assistant Examiner* — Alex Torres-Rivera
(74) *Attorney, Agent, or Firm* — Zagorin Cave LLP

(57) ABSTRACT

Reference signal generators using thermistors are disclosed. An apparatus includes a first device having a first temperature coefficient and a thermistor having a second temperature coefficient having a sign opposite to that of the first temperature coefficient. A circuit maintains equivalence of a first signal and a second signal and offsets a first temperature variation of the first device using a second temperature variation of the thermistor to generate the second signal having a low temperature coefficient. The first device may be a bipolar transistor configured to generate a base-emitter voltage and coupled in series with the thermistor. The first signal may be a first voltage on a first node. The second signal may be a second voltage on a second node. The circuit may be configured to maintain effective equivalence of the first voltage and the second voltage. The apparatus may include a resistor coupled to the second node.

16 Claims, 5 Drawing Sheets

(56) References Cited

U.S. PATENT DOCUMENTS

| | | | | |
|---|---|---|---|---|
| 2011/0254613 | A1* | 10/2011 | Kim | H01L 25/16 327/513 |
| 2012/0043999 | A1 | 2/2012 | Quevy et al. | |
| 2012/0133448 | A1 | 5/2012 | Gregg et al. | |
| 2012/0133848 | A1 | 5/2012 | Williamson | |
| 2012/0161741 | A1* | 6/2012 | Zambetti | G05F 3/262 323/294 |
| 2012/0268216 | A1 | 10/2012 | Borremans | |
| 2012/0274410 | A1 | 11/2012 | Koyama | |
| 2013/0106497 | A1 | 5/2013 | Lutz et al. | |
| 2013/0239695 | A1* | 9/2013 | Tai | G05F 1/463 73/766 |

OTHER PUBLICATIONS

'Putter, B.M., "On-chip RC measurement and calibration circuit using Wheatstone bridge," IEEE International Symposium on Circuits and Systems, 2008. ISCAS 2008, May 18-21, 2008, pp. 1496-1499.

* cited by examiner

USE OF A THERMISTOR WITHIN A REFERENCE SIGNAL GENERATOR

BACKGROUND

1. Field of the Invention

The present invention relates to integrated circuits and more particularly generating a reference signal in integrated circuits.

2. Description of the Related Art

In general, a bandgap reference circuit provides a voltage reference with improved temperature stability and is less dependent on power supply voltage than other known voltage reference circuits. Bandgap reference circuits typically generate a reference voltage approximately equal to the bandgap voltage of silicon extrapolated to zero degrees Kelvin, i.e., $V_{G0}$=1.205V. Typical voltage reference circuits include a current minor coupled to the power supply and the voltage reference node to provide a current proportional to absolute temperature (i.e., PTAT) to the voltage reference node. These circuits can be made with relatively low cost, but have the disadvantages of being sensitive to mechanical strain and/or aging, which reduces the accuracy of the voltage reference. In addition, typical voltage reference circuits generate PTAT (or equivalent) output currents that vary across temperature, which make those voltage references less useful as standalone current generators. An additional voltage-to-current generator is typically used to stabilize the output current.

Accordingly, improved techniques for generating reference voltages are desired.

SUMMARY OF EMBODIMENTS OF THE INVENTION

Reference signal generators using thermistors are disclosed. In at least one embodiment of the invention, an apparatus includes a first device having a first temperature coefficient and a thermistor having a second temperature coefficient. The second temperature coefficient has a sign opposite to a sign of the first temperature coefficient. The apparatus includes a circuit configured to maintain equivalence of a first signal and a second signal and further configured to offset a first temperature variation of the first device using a second temperature variation of the thermistor to generate the second signal having a low temperature coefficient. The first device may be a bipolar transistor configured to generate a base-emitter voltage. The thermistor may be coupled in series with the bipolar transistor. The first signal may be a first voltage on a first node, and the second signal may be a second voltage on a second node. The circuit may be configured to maintain effective equivalence of the first voltage and the second voltage. The apparatus may include a resistor coupled to the second node and having a third temperature coefficient. The third temperature coefficient may have a magnitude substantially less than a magnitude of the first temperature coefficient and substantially less than a magnitude of the second temperature coefficient. The first signal may be a first current and the second signal may be a second current. The first device may be a metal-oxide-semiconductor field-effect transistor (MOSFET) device coupled to the thermistor and coupled to a second MOSFET device having a different gate-to-source voltage than the first MOSFET device.

In at least one embodiment of the invention, a method includes. maintaining equivalence of a first signal and a second signal. The method includes offsetting a temperature variation of a third signal having a first temperature coefficient using a thermistor having a second temperature coefficient to generate the second signal having a low temperature coefficient. Maintaining equivalence may include generating an indicator of a voltage difference between a first voltage on a first node coupled to a first load including a series combination of the thermistor having a resistivity proportional to temperature and a diode having the first temperature coefficient. The second signal may be a second voltage on a second node coupled to a second load. The method may include adjusting the first and second signals in response to the indicator. The method may include controlling a first current source to generate the first voltage in response to the indicator. The method may include controlling a second current source to generate the second voltage in response to the indicator. The first signal may be a first current and the second signal may be a second current. Offsetting the temperature variation may include using the thermistor to compensate for a difference in gate-to-source voltages of a first metal-oxide-semiconductor field-effect transistor (MOSFET) device and a second MOSFET device.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DETAILED DESCRIPTION

A typical bandgap voltage reference utilizes temperature behavior of diodes to generate a voltage having a negative temperature coefficient (i.e., a negative first-order temperature coefficient) and a voltage having a positive temperature coefficient (i.e., a positive first-order temperature coefficient) and combines those voltages to produce an approximately zero temperature coefficient reference voltage. In general, voltage reference circuits take advantage of two electrical characteristics to achieve the desired $V_{REF}$: the $V_{BE}$ of a bipolar transistor is nearly complementary to absolute temperature, e.g., $V_{BE}$=(−1.5 mV/°K*T+1.22)V, and $V_T$ is proportional to absolute temperature, i.e, $V_T$=kT/q. Although pure diodes are preferable because they generate a higher diode drop for the same current, the typical bandgap voltage reference manufactured in a complementary metal-oxide-semiconductor (CMOS) process uses diode-coupled, bipolar junction transistors (i.e., BJTs or bipolar transistors), which are readily available in a CMOS process (e.g., PNPs for instance are bipolar devices formed from P-diffusion, an N-well, and a P-well in a CMOS process). The voltage across the diodes (or diode-coupled bipolar junction transistors) has a negative temperature coefficient, but the voltage difference between two diode drops in which the current densities differ is proportional to absolute temperature (PTAT). The use of two banks of bipolar junction transistors of different sizes (or two identical banks with different currents) can generate $\Delta V_{BE}$. The typical bandgap forces $\Delta V_{BE}$ across a relatively temperature insensitive resistor (e.g., a polysilicon resistor) using negative feedback, which generates a PTAT current through the resistor. Another resistor is placed in series, which amplifies $\Delta V_{BE}$ to cancel the negative temperature coefficient of the diode drop.

Figure 1:
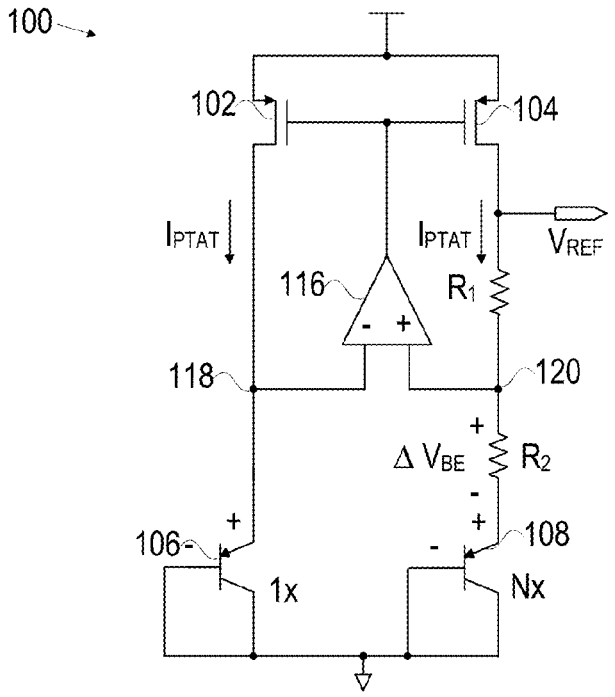
FIG. 1 illustrates a voltage reference generator circuit.
Figure 2:
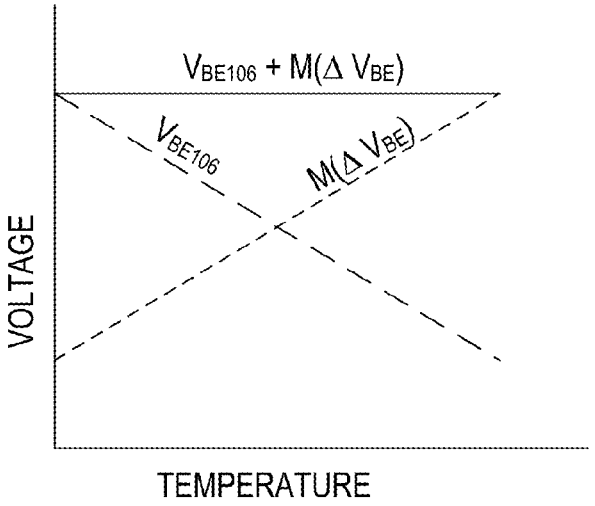
FIG. 2 illustrates voltage as a function of temperature for various nodes of the voltage reference generator circuit of FIG. 1.

Referring to FIG. 1, a typical voltage reference circuit (e.g., voltage reference generator 100) provides a temperature stable reference voltage, $V_{REF}$. A voltage proportional to absolute temperature (i.e., a PTAT voltage) may be obtained by taking the difference between two $V_{BE}$s biased at different current densities:

$$\Delta V_{BE} = V_T \ln\left(\frac{J_1}{J_2}\right),$$

where $J_1$ and $J_2$ are the current densities of corresponding bipolar transistors. Accordingly, voltage reference circuit 100 includes a pair of PNP bipolar transistors (i.e., transistors 106 and 108) that are coupled in a diode configuration (i.e., the collectors and bases of these transistors are coupled together) and coupled to ground. Transistor 108 has an area that is N times larger than the area of transistor 106. Thus, the current densities of transistor 108 and transistor 106 vary by a factor of N. The emitter of transistor 106 is coupled to an inverting input of operational amplifier 116. The emitter of transistor 108 is coupled, via resistor $R_1$, to the non-inverting input of operational amplifier 116. Operational amplifier 116 maintains equivalent voltages at nodes 118 and 120, i.e., $V_{118}=V_{120}=V_{BE106}$. Hence, the difference between $V_{BE106}$ and $V_{BE108}$ (i.e., $\Delta V_{BE106,108}$) forms across resistor $R_2$. Operational amplifier 116 and transistors 102 and 104 convert this voltage difference into a current (i.e., current $I_{PTAT}$) proportional to the voltage difference:

$$I_{PTAT} = \frac{\Delta V_{BE106,108}}{R_2} = \frac{V_T \ln(N)}{R_2}$$

Since the thermal voltage $V_T$ is proportional to absolute temperature via the constant factor k/q, $k=1.38*10^{-23}$J/K and $q=1.6*10^{-19}$C, the current proportional to the voltage difference is also proportional to an absolute temperature, i.e., $I_{PTAT}$ is a PTAT current.

Transistor 108 provides a voltage nearly complementary to absolute temperature (i.e., a 'CTAT' voltage) because the $V_{BE}$ of a bipolar transistor is nearly complementary to absolute temperature. By compensating the PTAT current with a CTAT voltage, transistors 102, 104, 106, and 108, and resistors $R_1$ and $R_2$, may be appropriately sized to generate a particular reference voltage output having an approximatley zero temperature coefficient:

$$V_{REF} = V_{BE106} + MV_T \ln(N), \text{ where } M = R_1 / R_2;$$

$$V_{REF} = 0.74\text{ V} + \frac{1.5\text{ mV}}{^\circ\text{ K}} T;$$

$$\text{at } 300^\circ\text{ K}, V_{REF} = 0.74\text{ V} + 0.45\text{ V} = 1.19\text{ V} \approx 1.2\text{ V}.$$

$V_{REF}$ is approximately equal to, $V_{G0}$=1.205V, i.e., the bandgap voltage of silicon extrapolated to zero degrees Kelvin.

Adding a PTAT voltage to a diode drop produces an approximately zero temperature coefficient point at approximately 1.2 V, resulting in a circuit that is not substantially sensitive to the effects of process variation on the bipolar junction transistor. The ratiometric manner in which the resistors are used also reduces effects of process variation, aging, and strain sensitivity. However, a noise transfer function of voltage reference circuit 100 is dependent on a ratio of the load resistors. In an exemplary embodiment of the voltage reference, the ratio of $R_1$ to $R_2$ is approximately 5 to 10 (i.e., $R_1/R_2 \approx 5\text{-}10$), and $\Delta V_{BE}$, which is typically less than 100 mV, is amplified along with its noise by operational transconductance amplifier 116. Operational transconductance amplifier 116 has a feedback factor of $R_2/(R_1+R_2)$, which causes a reduction in loop gain and bandwidth from the open loop gain.

Figure 3:
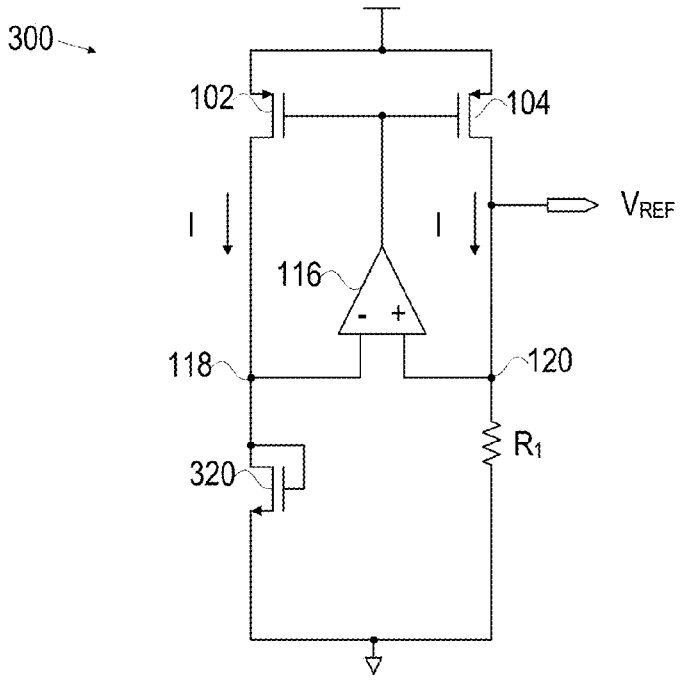
FIG. 3 illustrates a voltage reference generator circuit having lower thermal noise than the voltage reference generator circuit of FIG. 1.

A technique for reducing effects of noise on the reference voltage as compared to noise sensitivity of a reference voltage generated by voltage reference generator 100 includes using a $V_{GS}$-R topology. For example, the voltage reference generator of FIG. 3 uses the zero temperature coefficient point of device 320, i.e., the point where a constant current causes no change in the $V_{GS}$ of device 320 due to cancellation of the negative temperature coefficient of the threshold voltage of device 320 with the overdrive voltage (i.e. $V_{DSAT}$) positive temperature coefficient of device 320. This circuit forces the voltage across a resistor with substantially no temperature coefficient to be equal or approximately equal to the zero temperature coefficient $V_{GS}$ of device 320. Although this circuit has lower thermal noise as compared to the circuit of FIG. 1, the circuit of FIG. 3 is sensitive to process variations since the reference voltage can be affected by the threshold voltage, resistance, mobility, oxide capacitance, and transistor dimensions. In general, the threshold voltage of a MOSFET is particularly sensitive to process variations. In addition, the load of circuit 300 has flicker noise that may be difficult or expensive to reduce or eliminate. For example, the flicker noise may be reduced by increasing the area of device 320 or by increasing $V_{REF}$, which effectively requires increasing the threshold voltage of device 320.

Figure 4:
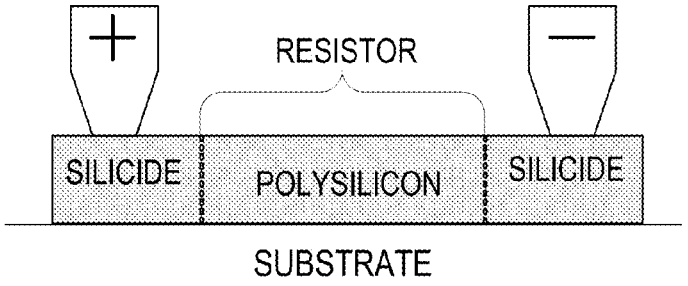
FIG. 4 illustrates an integrated circuit polysilicon resistor.
Figure 5:
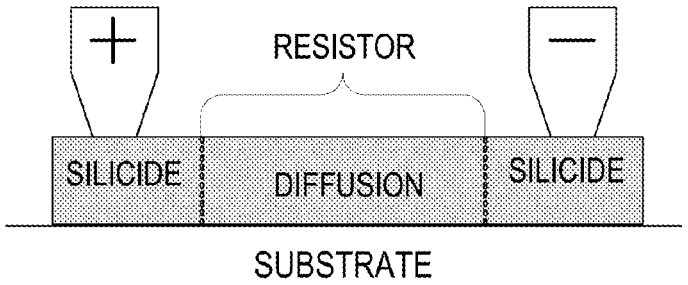
FIG. 5 illustrates an integrated circuit diffusion resistor.

Referring to FIGS. 3 and 4 conventional CMOS analog circuits and bandgap voltage reference circuits use polysilicon resistors. Polysilicon resistors typically have highly linear resistances and are designed to have small temperature coefficients. However, polysilicon resistors are sensitive to aging and strain due to their polycrystalline structure. Referring to FIG. 5, typical CMOS processes also include diffusion resistors, which are less commonly used due to their large voltage and temperature coefficients. Diffusion resistors are also considered piezoresistive, i.e., sensitive to strain. Although the voltage reference generators that use thin film polysilicon resistors or diffusion resistors when building a bandgap or $V_{GS}$-R reference circuit are relatively low cost, the response of those resistors to mechanical strain and/or aging degrades the accuracy of the reference voltage. In addition, more power efficient references require lower noise alternatives to satisfy specifications of associated application. Those circuits may generate PTAT (or similar) output currents that vary with temperature variation, making them less useful as standalone current generators. Therefore, an additional voltage-to-current generator may be included to stabilize the output currents.

Figure 6:
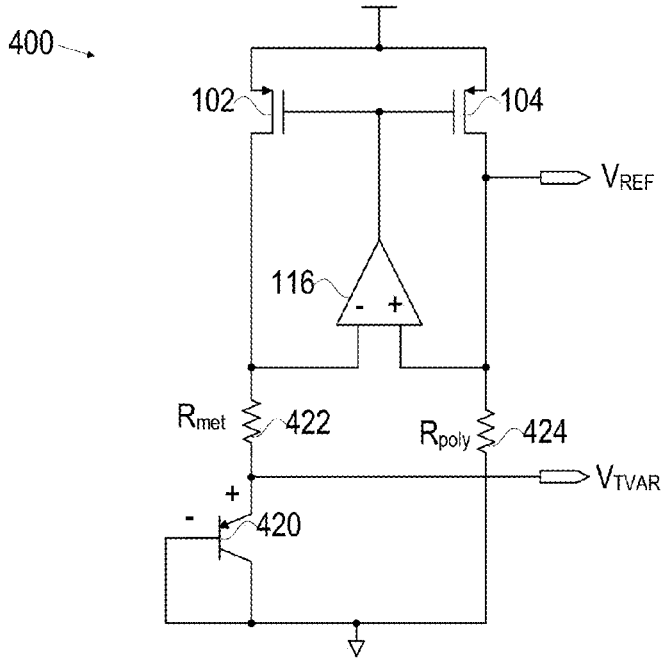
FIG. 6 illustrates a voltage reference generator circuit including a thermistor consistent with at least one embodiment of the invention.

Referring to FIG. 6, a $V_{BE}$-$R_{thermistor}$ voltage reference generator technique generates a reference voltage by forcing a constant current into a series combination of a thermistor 422 having a resistance $R_{thermistor}$, and a diode, e.g., diode-coupled bipolar junction transistor 420. The current is determined by comparing the voltage across that load with a voltage across polysilicon resistor, e.g., polysilicon resistor 424, having a resistance, $R_{constant}$, that is constant with respect to temperature variation. This topology has a lower operational transconductance amplifier noise transfer function than conventional bandgap voltage reference generators and has a more consistent output voltage than a $V_{GS}$-R voltage reference generator. In addition, the load of a $V_{BE}$-$R_{thermistor}$ voltage reference generator generates little or no flicker noise. Thus the only substantial sources of flicker noise are operational transconductance amplifier 116 and one or more current sources included in voltage reference generator 400 (e.g., devices 102 and 104). The operational transconductance amplifier noise can be reduced or eliminated using chopping or other techniques known in the art. The current sources of a $V_{BE}$-$R_{thermistor}$ voltage reference generator have larger noise transfer functions than current sources in conventional bandgap voltage reference generators and may dominate the noise. Nonetheless, the $V_{BE}$-$R_{thermistor}$ voltage reference generator topology may offer a lower thermal noise floor at the same power consumption as conventional voltage reference generators. In at least one embodiment of a $V_{BE}$-$R_{thermistor}$ voltage reference generator, only one current source is used (e.g., the two current sources are combined using a single device). For example, the drain of the current source node is coupled to two paths including resistors and/or cascode devices, or other suitable circuit elements, that allow operational transconductance amplifier 116 to receive a differential signal that may be processed by the feedback loop to establish a valid operating point. As a result, any variation in the current source current does not affect the ratio of currents in the two branches of the load, the stable operating point does not change, so the feedback maintains $V_{REF}$ at its original value. Thus, the loop gain of the feedback suppresses noise and the noise would be zero in an infinite gain system.

By making use of thermistors, i.e., resistors that have a resistance that varies substantially with temperature, e.g., PTAT metal resistors and/or PTAT silicided resistors, in the core of the voltage reference generator, only a constant current may be generated and provided to $R_{thermistor}$ to maintain a zero temperature coefficient on $V_{REF}$. Accordingly, a voltage-to-current generator that generates a constant current that may be required by other voltage reference generator topologies can be eliminated when there is no need for alterative circuits elsewhere in the system. In addition, since metal and silicide resistors are not piezoresistive, the associated voltage reference generator response has little or no strain sensitivity. Moreover, aging of these types of metal and silicide resistors is generally superior to alternative integrated circuit resistors, increasing stability of the output voltage as a function of time. Another benefit of embodiments of the $V_{BE}$-$R_{thermistor}$ voltage reference generator includes lower noise than conventional voltage reference generator topologies.

Figure 7:
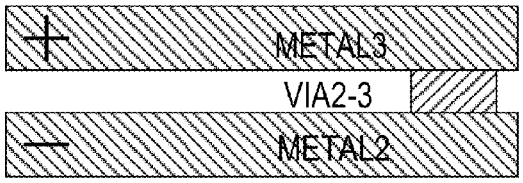
FIG. 7 illustrates an integrated circuit metal resistor.
Figure 8A:
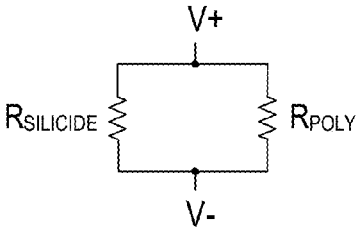
FIGS. 8A and 8B illustrate an integrated circuit silicided polysilicon resistor.
Figure 8B:
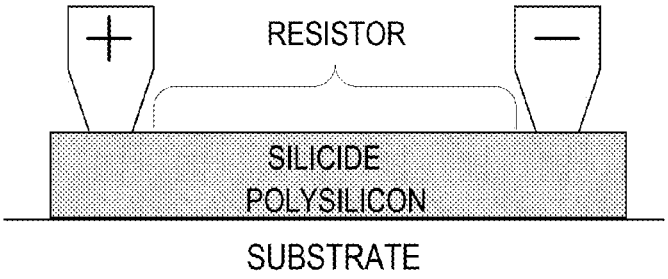

Metal resistors are not commonly used in conventional analog circuits and bandgap voltage reference circuits since metal layers in typical CMOS processes are intended to provide low-resistance interconnects and thus have very low sheet resistance. The low sheet resistance (e.g., 60 milli-Ohms per square) requires resistors having large area to implement even small resistances (e.g., 10-20 kilo-Ohms) However, a stack of multiple metal layers coupled by conductive via(s) of a CMOS process may be configured as electrically coupled metal resistors (e.g., FIG. 7) that have reduced area as compared to a typical CMOS resistor, (e.g., a planar resistor formed using a narrow, serpentine metal trace implemented using a single CMOS metal layer). In at least one embodiment, the thermistor comprises a metal resistor having a resistance, $R_{thermistor}$, of approximately zero Ohms Referring to FIGS. 6, 8A, and 8B, in at least one embodiment, thermistor 422 includes silicided-polysilicon resistors, which are polysilicon resistors without the silicide blocked. Silicide is metal that is injected into the top of polysilicon or diffusion to decrease the sheet resistance. This means that thermistors of silicided-polysilicon resistors have a combination of polysilicon and metal resistor properties, which makes them close to a PTAT resistor. Silicided-polysilicon resistors are less sensitive to strain and aging than conventional CMOS resistors. Typical silicided-polysilicon resistors have higher sheet resistances than metal resistors (e.g., 10 times the typical sheet resistance of metal) and result in metal resistors with higher resistances for the same area (e.g., 100-200 kilo-Ohms)

Referring back to FIG. 6, although thermistor 422 is illustrated as a single metal resistor, in other embodiments of a $V_{BE}$-$R_{thermistor}$ voltage reference generator, thermistor 422 includes a network of individual thermistor elements and/or includes one or more silicided-polysilicon resistors. In at least one embodiment, the circuit of FIG. 6 may be used as a temperature sensor or as a combination voltage reference generator and temperature sensor by providing a temperature-varying signal from the load (e.g., $V_{TVAR}$). Note that in other embodiments, $V_{TVAR}$ may be the voltage drop across $R_{met}$ or a combination of the $V_{BE}$ of diode-coupled bipolar junction transistor 420 and the voltage drop across $R_{met}$. Other embodiments of a $V_{BE}$-$R_{thermistor}$ voltage reference generator combine the metal resistor with a polysilicon resistor to form one composite resistor with an arbitrary first-order temperature coefficient. The composite resistor embodiment of a $V_{BE}$-$R_{thermistor}$ voltage reference generator allows generation of a constant reference voltage at a voltage other than the bandgap voltage of silicon. In addition, the composite resistor embodiment of a $V_{BE}$-$R_{thermistor}$ voltage reference generator may be exploited for generation of an arbitrary first-order temperature coefficient current.

Figure 9:
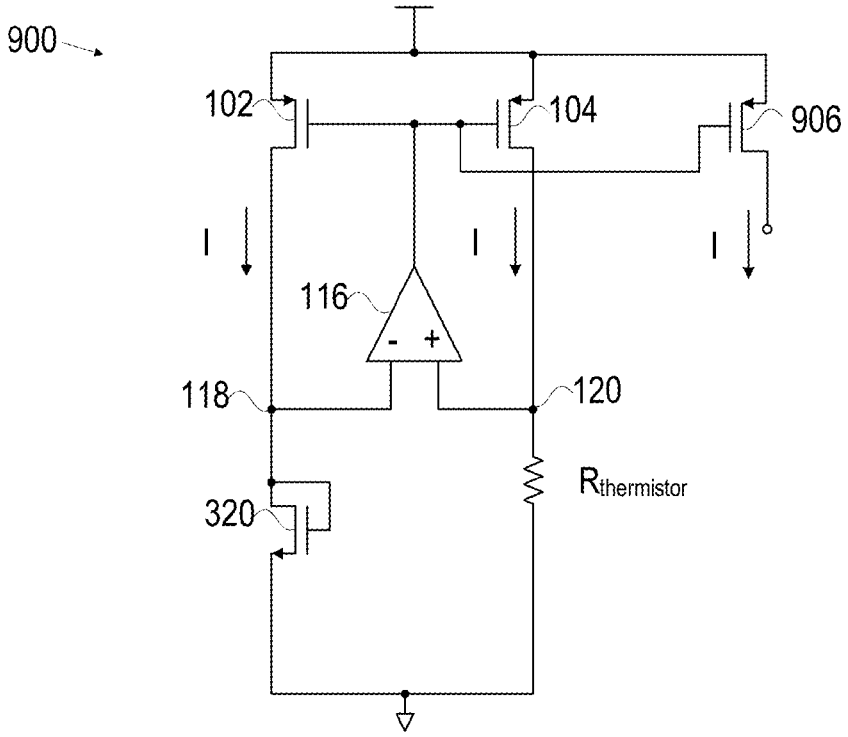
FIG. 9 illustrates a $V_{GS}$-R voltage reference generator circuit including a thermistor consistent with at least one embodiment of the invention.

Referring to FIG. 9, in at least one embodiment, a reference generator having a $V_{GS}$-R topology includes a thermistor and is configured to generate a current, I, that is constant with respect to temperature variations, i.e., has current with an approximately zero temperature coefficient. By including a thermistor with a positive temperature coefficient, the voltages across the resistor and device 320 can be higher than in typical $V_{GS}$-R reference generators and circuit 900 has improved thermal noise as compared to a current generator using circuit 300 of FIG. 3.

Figure 10A:
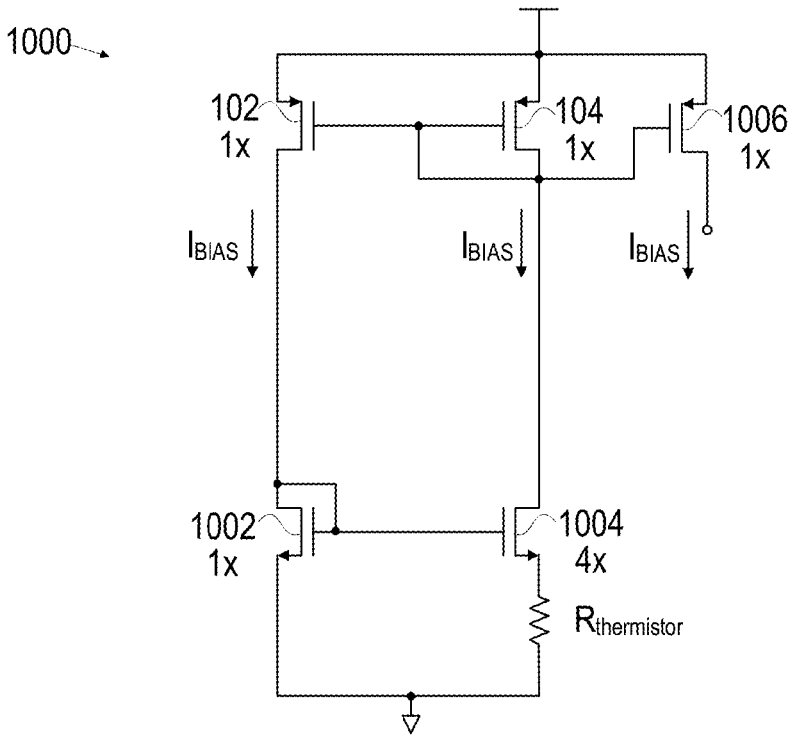
FIGS. 10A and 10B illustrate various embodiments of a current reference generator circuit including a thermistor consistent with at least one embodiment of the invention.
Figure 10B:
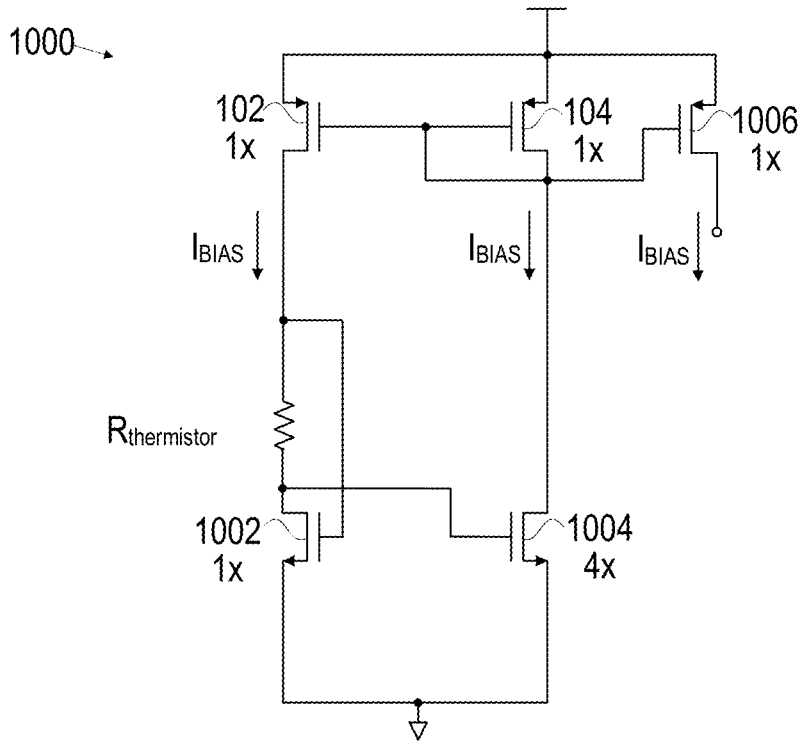

Referring to FIGS. 10A and 10B, reference generator 1000 generates a current that has a low or approximately zero temperature coefficient. Devices 1002 and 1004 have different sizes, but are biased with the same gate voltage. Since devices 102 and 104 are matched, the currents through devices 102 and 104 are equal to $I_{BIAS}$. Reference generator 1000 achieves a stable operating point when the voltage drop across the thermistor compensates for the difference in the gate-to-source voltages of devices 1002 and 1004. This topology is may be used with a resistor having no temperature coefficient where the difference in the gate-to-source voltages of devices 1002 and 1004 are used to generate a bias signal with a constant transconductance. By using a thermistor, the circuit may be used as a constant current reference without a bipolar junction transistor.

Circuits 1000 are less sensitive to process variations than the $V_{GS}$-R topology described above since the threshold voltage does not affect the bias current. In addition, circuit 1000 can operate at a lower supply voltage since 1.2V is not required to produce a bandgap voltage. Circuit 1000 is simpler than other reference generator circuits since the circuit behaves as an amplifier and an operational transconductance amplifier is not required. However the output currents of circuits 1000 may include flicker noise and may be noisier than the output of a $V_{GS}$-R reference, but not as noisy as a bandgap voltage reference generator. Circuits 1000 are strain insensitive. Note that circuits 1000 do not generate a voltage with a zero temperature coefficient since the constant current that flows through the thermistor results in a temperature dependent voltage. The temperature coefficient of the thermistor should be less than a metal resistors PTAT resistivity. Accordingly, the thermistor may be implemented using a polysilicon resistor in series with a metal resistor to obtain the target temperature coefficient. Note that circuits 1000 and the other self-biased circuits described herein require a startup circuit to prevent the circuit from latching in an off state. Any suitable startup circuit known in the art may be used.

The description of the invention set forth herein is illustrative, and is not intended to limit the scope of the invention as set forth in the following claims. For example, while the invention has been described in an embodiment in which p-type MOSFETs are configured as current sources and a PNP-type bipolar junction transistor is used to generate the $V_{BE}$, one of skill in the art will appreciate that the teachings herein can be utilized with n-type MOSFETs configured as current sinks and an NPN-type bipolar junction transistor coupled to generate the $V_{BE}$. In addition, diodes may be stacked to further enhance $\Delta V_{BE}$ (e.g., for embodiments including two diodes stacked in series for each bipolar device, $\Delta V_{BE}$ becomes $V_T \ln(N^2)$). Variations and modifications of the embodiments disclosed herein, may be made based on the description set forth herein, without departing from the scope and spirit of the invention as set forth in the following claims.

What is claimed is:

1. An apparatus comprising:

a first device having a first temperature coefficient;

a thermistor having a second temperature coefficient, the thermistor being coupled in series with the first device and the second temperature coefficient having a sign opposite to a sign of the first temperature coefficient;

a circuit configured to maintain equivalence of a first signal and a second signal to offset a first temperature variation of the first device using a second temperature variation of the thermistor to generate the second signal having a low temperature coefficient, the first signal being received by the circuit on a first node, and the second signal being received by the circuit on a second node; and a resistor coupled to the second node and having a third temperature coefficient, the third temperature coefficient having a magnitude substantially less than a magnitude of the first temperature coefficient and substantially less than a magnitude of the second temperature coefficient.

2. The apparatus, as recited in claim 1, wherein the first device is a bipolar transistor configured to generate a base-emitter voltage, the first signal is a first voltage on the first node, and the second signal is a second voltage on the second node, and the circuit is configured to maintain effective equivalence of the first voltage and the second voltage.

3. The apparatus, as recited in claim 2, wherein the second voltage has a temperature coefficient of approximately zero.

4. The apparatus, as recited in claim 2, wherein the apparatus is configured as a temperature sensor circuit and the circuit provides as an output signal an indicator of a difference between the first voltage and the second voltage.

5. The apparatus, as recited in claim 2, further comprising:

a first current source coupled to the first node and responsive to a signal generated by the circuit indicating a difference between the first signal and the second signal; and a second current source coupled to the second node and responsive to the signal generated by the circuit indicating the difference between the first signal and the second signal.

6. The apparatus, as recited in claim 1, wherein the resistor is a polysilicon resistor having a temperature coefficient of approximately zero.

7. The apparatus, as recited in claim 1, wherein the circuit comprises an operational amplifier coupled to the first node and the second node.

8. The apparatus, as recited in claim 1, further comprising:

a second device of a first type coupled to a power supply node and the first node and controlled by an output of the circuit; and a third device of the first type coupled to the power supply node and the second node and controlled by the output of the circuit.

9. The apparatus, as recited in claim 1, wherein the thermistor comprises a metal resistor having a resistivity that is approximately proportional to temperature.

10. The apparatus, as recited in claim 1, wherein the thermistor comprises a metal resistor having a resistance of approximately zero Ohms.

11. The apparatus, as recited in claim 1, wherein the thermistor comprises a stack of multiple metal layers.

12. The apparatus, as recited in claim 1, wherein the thermistor is a silicided polysilicon resistor having a resistivity that is approximately proportional to temperature.

13. The apparatus, as recited in claim 1, wherein the resistor is connected between the second node and a power supply node and the thermistor is coupled between the first device and the first node.

14. An apparatus comprising:

a first metal-oxide-semiconductor field-effect transistor (MOSFET) device having a first type and a first temperature coefficient and being coupled between a first power supply node and a first node;

a second MOSFET device having the first type and being coupled between the first power supply node and a second node, the first MOSFET device having a first gate terminal coupled to a second gate terminal of the second MOSFET device, the first MOSFET device being configured to have a first gate-to-source voltage and the second MOSFET device being configured to have a second gate-to-source voltage, the first gate-to-source voltage being different from the second gate-to-source voltage;

a third MOSFET device having a second type and being coupled between a second power supply node and the first node;

a fourth MOSFET device having the second type and being coupled between the second power supply node and the second node, the third MOSFET device having a third gate terminal coupled to a fourth gate terminal of the fourth MOSFET device; and a thermistor having a second temperature coefficient, the second temperature coefficient having a sign opposite to a sign of the first temperature coefficient, the thermistor being coupled to the second MOSFET device and configured to provide a voltage drop that compensates for a difference between the first gate-to-source voltage and the second gate-to-source voltage to generate a bias signal with a constant transconductance.

15. The apparatus, as recited in claim 14, wherein the apparatus provides a current that is constant with respect to change in temperature without a bipolar junction transistor and without an operational transconductance amplifier.

16. The apparatus, as recited in claim 14, wherein the thermistor comprises a metal resistor having a resistivity that is approximately proportional to temperature.

* * * * *